United States Patent [19]

Simonsen et al.

[11] Patent Number: 4,637,676

[45] Date of Patent: Jan. 20, 1987

[54] TERMINAL BLOCK MARKING SURFACE

[75] Inventors: Glenn H. Simonsen, Brookfield; Clayton J. Klotz, Waukesha, both of Wis.

[73] Assignee: Allen-Bradley Company, Milwaukee, Wis.

[21] Appl. No.: 733,107

[22] Filed: May 13, 1985

[51] Int. Cl.[4] ..... H01R 9/26

[52] U.S. Cl. ..... 339/113 R; 339/198 GA; 339/198 J

[58] Field of Search ..... 339/113 R, 113 B, 113 L, 339/198 G, 198 GA, 198 H, 198 J

[56] References Cited

U.S. PATENT DOCUMENTS

| | | | |
|---|---|---|---|
| 2,981,922 | 4/1961 | Van Valkenburg et al. | 339/198 |
| 2,983,897 | 5/1961 | Blanchet | 339/113 B |
| 3,135,572 | 6/1964 | Curtis et al. | 339/198 |
| 3,157,453 | 11/1964 | Lanczi | 339/113 B |
| 3,236,975 | 2/1966 | De Smidt et al. | 200/133 |
| 3,247,480 | 4/1966 | Orzechowski | 339/198 |
| 3,275,972 | 9/1966 | Eisert | 339/198 |
| 3,293,593 | 12/1966 | Nielsen et al. | 339/198 |
| 3,496,521 | 2/1970 | Hohorst | 339/198 GA |
| 3,510,830 | 5/1970 | Wieland | 339/198 GA |
| 3,992,074 | 11/1976 | Rymer | 339/198 GA |
| 4,133,598 | 1/1979 | Kuntzsch | 339/198 G |
| 4,180,305 | 12/1979 | Ustin et al. | 339/198 H |

*Primary Examiner*—John McQuade

*Attorney, Agent, or Firm*—Quarles & Brady

[57] ABSTRACT

An electrical wire terminal block including a hinged marking strip overlaying a transversely disposed apertured ledge and arranged to either include an integrally molded "living" hinge area of reduced cross-section or, in the alternative, including the hinge portion intermediate its ends and with a retainer portion detachably retained in a dual purpose orintation aperture in the ledge. The remaining apertures in the ledge provide access means for adjusting clamping screws, in addition to providing a retention means for detachably receiving a detent element on the marking strip.

2 Claims, 3 Drawing Figures

TERMINAL BLOCK MARKING SURFACE

BACKGROUND OF THE INVENTION

The invention relates to a terminal block for connecting two sets of electrical conductors.

One common type of terminal block is formed by mounting individual connector units on a track or channel traversing the bottom of the connector units. This track is severable to yield terminal blocks with separate numbers of connector units as described by W. A. DeSmidt et al in U.S. Pat. No. 3,236,975. A very novel feature of the DeSmidt et al disclosure resided in providing individual, severable terminal units. This permitted a single unit to be removed from a series of units. The prior art devices required several units to be either joined with one another, or if removable, the removal of a unit or several units at either one or both sides of the unit to be inserted or removed from a common track. The novel feet of flexible material at each side of the DeSmidt et al individual units were arranged to be dislodged from the supporting track by means of a screwdriver or the like. Cam-like surfaces permitted "snap on" insertion of an individual unit.

The DeSmidt et al patent, assigned to the same assignee as the present invention, also disclosed the reception of marking strips at the top of the several units. In the case of multiple unit terminal blocks, the marking strip was disposed longitudinally across the tops of a plurality of the individual connector units. Such devices have also been disclosed in the E. J. Nielsen et al U.S. Pat. No. 3,293,593 and H. C. Curtis et al, U.S. Pat. No. 3,135,572.

It will be readily apparent that marking strips disposed to lie across a series of adjacent terminal blocks interfere with the insertion and removal of individual blocks, especially those of the type of the DeSmidt et al U.S. Pat. No. 3,236,975. In addition, the longitudinally arranged marking strip offers no protection for internal conductive components.

The Donald W. Kuntzsch U.S. Pat. No. 4,133,598 assigned to the present assignee provides certain protection, but the terminals are joined at a common base and the longitudinal marking surface is not intended to permit separation of severable blocks.

Many of the advantages of these prior constructions can be obtained without the concomitant limitations of the prior art in a new, multiple connector with individual terminal blocks, and without disturbing the present construction of the individual blocks.

SUMMARY OF THE INVENTION

It is the general object of this invention to provide an overlaying, hinged marking strip having the dual purpose of providing an individual marking surface and a protective cover for individual terminal blocks.

The invention relates, as disclosed in an embodiment thereof, to a molded terminal block which includes a base portion detachably engageable with a track member and an upstanding barrier wall which includes an integrally molded, laterally extending, apertured ledge sidewalls and a pedestal spaced from said ledge each cooperating to define a recessed area; a wire terminal unit is disposed in the recessed area and supported by the pedestal. The wire terminal unit includes threadingly engageable clamping screws which are in substantial alignment with apertures in the ledge; and in combination therewith, a hinged marking strip having an exposed marking surface and overlaying the apertured ledge for covering the screw-aligning apertures and having one end thereof including a hinge element and the opposite end thereof releasably engageable with another aperture in the ledge.

Separate embodiments of the present invention include a marking strip having a "living hinge" integrally molded with the terminal block and, in another version, a detachable marking strip unit having one end adapted to be inserted in and supported by an aperture in the said ledge of the terminal block and defining a relatively thin cross section to provide a "living hinge" portion at one end thereof.

Other objects and advantages of the invention will be apparent from the drawings, description and claims that follow.

DESCRIPTION OF THE PREFERRED EMBODIMENT

Figure 1:
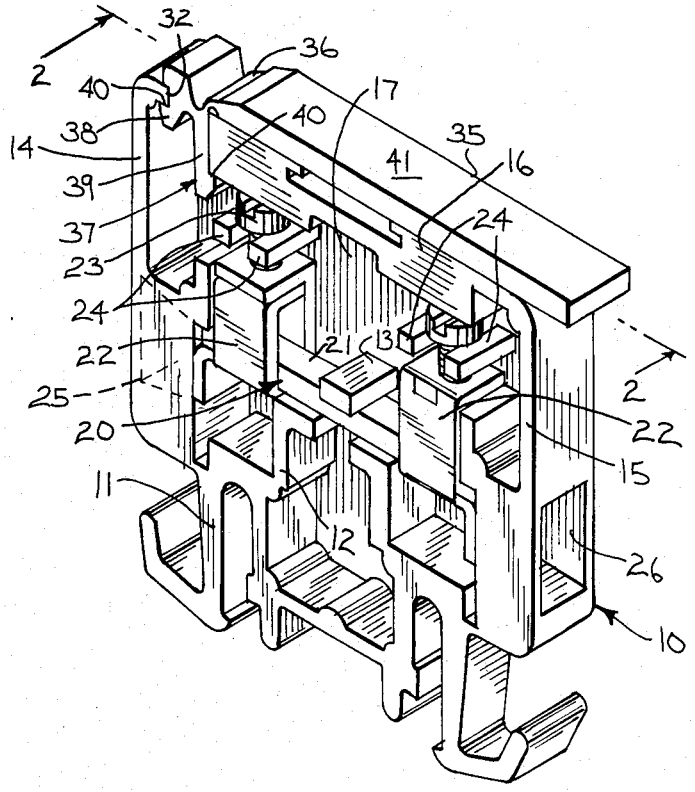
FIG. 1 is a perspective view of an embodiment of the terminal block of this invention.
Figure 2:
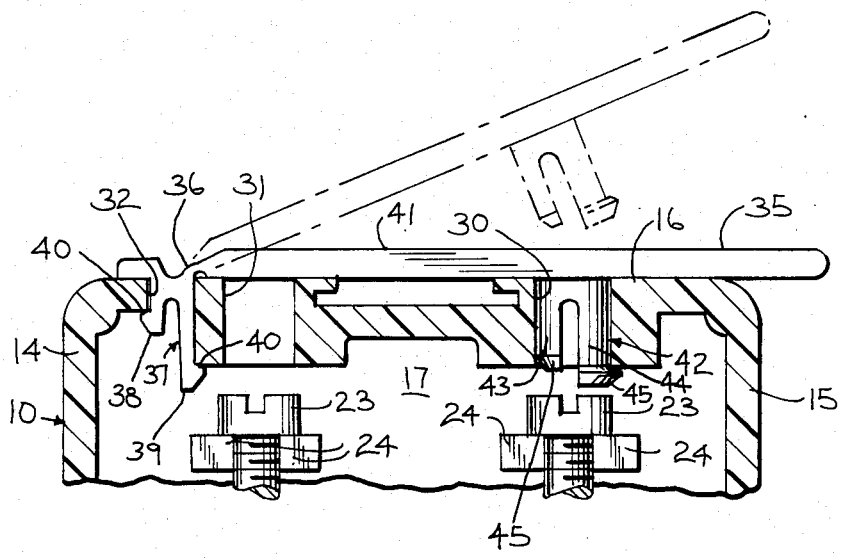
FIG. 2 is a side elevational view of the terminal block of FIG. 1.

As shown in FIGS. 1 and 2, the terminal block 10 includes an integrally molded base 11 of thermoplastic material, a molded pedestal 12, a molded stop 13, sidewall portions 14 and 15 and a transversely molded ledge 16. The sidewalls 14, 15, the ledge 16 and the pedestal 12 cooperate to define a cavity or recessed area 17. A wire terminal unit 20 includes a pressure plate 21 supported between the pedestal 12 and the cooperating stop 13. The unit 20 is adapted to receive at opposite ends thereof threaded connector barrels 22 threadingly receiving clamping screws 23. The screws 23 are "captured" in cooperating, grooved retainers 24. Openings 25 and 26 in the sidewalls 14 and 15 respectively provide a means of access for wire conductors (not shown) to be clamped or gripped between the pressure plate 21 and the chambers of the respective barrels 22.

The elements of the base portion 11 will not be described, since they have been amply described and claimed in the DeSmidt et al U.S. Pat. No. 3,236,975 mentioned earlier herein.

Attention is next directed to the ledge 16, which is provided with at least three apertures 30, 31 and 32. The apertures 30 and 31 are provided as an access means for a screwdriver or other tool engageable with the head of the respective screws 23 of the wire terminal unit 20. The ledge 16 may also contain a conventional notch for accommodating a common marking strip (not shown) as discussed in the Neilsen et al U.S. Pat. No. 3,293,593. This permits a common marking strip to be placed across a series of adjoining terminal blocks (not herein shown).

The present embodiment includes an identifying aperture 32 which is intended for orientation of terminal blocks, and as a means of minimizing improper insertion and placement of terminal blocks relative to adjoining blocks. That is, because the individual terminal blocks are of open construction to expose the recessed area 17 for initial placement of the wire terminal unit 20, should two units be accidentally reversed relative to one another, there is every possibility of causing short-circuited situation between adjoining wire terminal units. An installing electrician will immediately take note of improper orientation of blocks by observing that the orientation apertures 32 of respective terminal blocks 10 are not in normal alignment relative to one another.

The embodiment of FIGS. 1 and 2 takes dual advantage of the orientation aperture 32 of the ledge 16. It may also serve, as shown, to receive the retainer portion 37 of the hinged marking strip 35. The second embodiment of FIG. 3, to be described later, discloses an integrally molded, hinged marking strip.

With particular reference to the marking strip 30 of the embodiment of FIGS. 1 and 2, it will be noted that the molded strip 35 includes at its left end (with reference to FIGS. 1 and 2) an intermediate hinge portion 36 of reduced cross section to define a so-called, "living hinge". That is, the preferred molding material (Nylon 6, polymerized from a single monomer known as Caprolactron, formulated and supplied by Allied Engineered Plastics of Morristown, N.J.) is quite satisfactory for providing an integrally molded "living hinge" 36. The hinge 36 permits the terminal marking strip 35, to be alternatively moved from open to closed position throughout the expected active life of the marking strip 35. The marking strip 35 is further formed to include an integrally molded retainer portion 37 for insertion into the aperture 32 of the ledge 16. The retainer portion 37 includes resilient, bifurcated leg portions 38 and 39, each including a detent shoulder 40 for engagement with the lower surface of the ledge 16 when the retainer portion 37 of the marking strip 35 has been inserted in the aperture 32 of the ledge 16. The exposed surface 41 of the strip 35 provides a marking surface, and this may be formed during molding by roughening the defining portion of the molding die, which is a well-known practice. The surface may be marked with pen or ink, or by an adhering decal indicia, in addition to receiving printed indicia having an adhesive backing.

Also disposed intermediate the ends of the marking strip is a laterally extending retainer portion 42 of a generally circular cross section and defining bifurcated leg portions 43 and 44 each having detent shoulder portions 45 for engagement with the internal surface of the aperture 30 of the ledge 16.

It will thus be apparent that the present embodiment has provided a novel marking strip 35, capable of serving in a dual capacity of supplying an exposed marking surface 41 and a protective cover which permits closure of all apertures in the ledge 16 after adjustment of the clamping screws 23 upon access of a screwdriver (not shown) through registering apertures 30 and 31. The aperture 32 also provides a dual function permitting initial orientation during assembly of the block to the track (not shown), as well as providing a retaining seat for receiving the retainer portion 37 of the marking strip 35.

Figure 3:
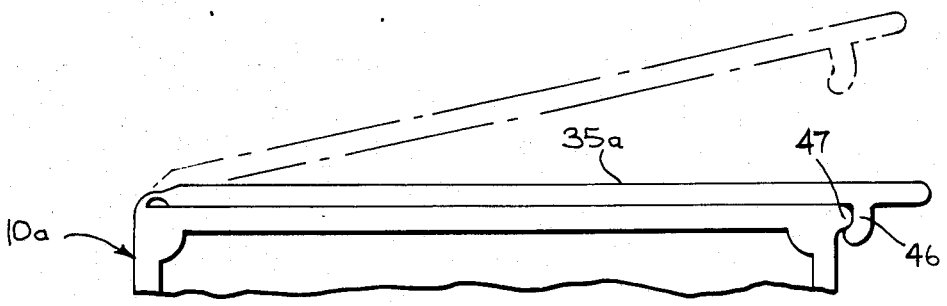
FIG. 3 is a side elevational view of the terminal block of another embodiment of the present invention.

Next, directing attention to the embodiment of FIG. 3, it will be noted that the various features of the first-described embodiment have been retained, with the primary difference being that the marking strip **35*a* has been integrally molded concurrently with the molding of the terminal block 10*a*. There is no need for an orientation aperture, such as the aperture 32, since visual orientation may be made by aligning each of the integrally molded hinged ends of the respective terminal block marking strips 35*a* to thereby minimize errors in initial placement of the blocks 10*a***.

In the present embodiment, the overlaying marking strip has also been modified in providing an integrally molded detent portion 46 detachably engageable with the laterally extending lip portion 47 formed at the top of the wall 15.

It will be apparent from the above description that the terminal block of this invention may be tailored to meet individual needs, such as providing the individual blocks, as shown, or to provide individual marking strips for a single molding defining several barrel-receiving cavities, such as disclosed in the Kuntzsch U.S. Pat. No. 4,133,598. Therefore, reference should be made to the following claims for the scope of the invention.

The embodiments of the invention of which an exclusive property or privilege is claimed are defined as follows:

1. A molded terminal block arranged for mounting on a supporting track and including;

a base portion having means for detachably engaging said track, an upstanding barrier wall having molded thereon and laterally extending therefrom an apertured ledge portion, a pedestal spaced from said ledge portion and oppositely disposed sidewalls, each cooperating to define a recessed area therebetween;

a wire terminal unit disposed in said recessed area and supported by said pedestal;

clamping screws threadingly engaging said terminal unit and having a portion extending into said recessed area, said screws being accessed for adjustment by means of substantially axially aligned ledge apertures;

a remaining ledge aperture providing identifying orientation means for positioning said terminal block relative to said track; and an elongated marking strip having an exposed marking surface and overlaying said apertured ledge portion to cover the screw-aligning apertures, one end of said marking strip being provided with a retainer portion insertable in and retained by the said remaining aperture and having the free end thereof releasably engageable with one of the screw-aligning ledge apertures, said marking strip further including an area of reduced cross section intermediate the ends thereof, said area defining an integrally formed hinge therein.

2. In a molded terminal block including;

a base portion;

an upstanding barrier member extending from said base portion and defining oppositely disposed sidewalls and a laterally extending pedestal;

a laterally extending ledge portion defining an orientation aperture and a pair of screw-access apertures;

said ledge portion, pedestal and sidewalls cooperating to define a recessed area in said barrier member;

a wire terminal unit disposed in said recessed area and including a pair of clamping screws in substantial alignment with said pair of screw-access apertures in said ledge portion for access of a screw-adjusting means;

an elongated marking strip extending transversely across and substantially parallel with the top of said barrier member and including a retainer portion insertable in and retained by said orientation aperture, said marking strip further including an area of reduced cross-section defining an integrally formed hinge and a detachable latching portion engageable with one of the screw-access apertures in the ledge portion.

* * * * *